US006241215B1

(12) United States Patent
Gersemsky et al.

(10) Patent No.: US 6,241,215 B1
(45) Date of Patent: Jun. 5, 2001

(54) PORTABLE WINCH

(75) Inventors: Udo Gersemsky, Herdecke; Uwe Lichtenvort, Essen; Giuliano Persico, Wetter; Heinz Flaig, Bochum; Jürgen Heun, Dortmund; Ralf Eising, Herne, all of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/426,961

(22) Filed: Oct. 26, 1999

(30) Foreign Application Priority Data

Oct. 30, 1998 (DE) ..... 198 51 708
Apr. 1, 1999 (DE) ..... 199 16 413

(51) Int. Cl.[7] ..... B66D 1/14

(52) U.S. Cl. ..... 254/342; 254/343; 254/356; 254/362; 254/380

(58) Field of Search ..... 254/334, 342, 254/343, 356, 359, 362, 363, 380

(56) References Cited

U.S. PATENT DOCUMENTS

| | | | | |
|---|---|---|---|---|
| 1,353,238 | * | 9/1920 | Holmes | 254/356 |
| 1,464,294 | * | 8/1923 | Reese | 254/342 |
| 3,788,607 | * | 1/1974 | Crooks | 254/343 |
| 4,434,973 | | 3/1984 | Desplats . | |
| 4,569,423 | * | 2/1986 | Hirano | 254/343 |
| 4,613,273 | * | 9/1986 | Wagner | 254/362 |
| 4,635,903 | | 1/1987 | Broyden et al. . | |
| 4,846,309 | * | 7/1989 | Nara et al. | 254/342 |
| 5,002,259 | * | 3/1991 | Manning et al. | 254/356 |
| 5,573,091 | * | 11/1996 | Hung | 254/356 |
| 5,603,489 | * | 2/1997 | Regal | 254/342 |
| 5,803,437 | * | 9/1998 | Paterson et al. | 254/343 |
| 5,970,813 | * | 10/1999 | Parkins et al. | 254/343 |

FOREIGN PATENT DOCUMENTS

| | | | | |
|---|---|---|---|---|
| 643292 | * | 4/1937 | (DE) | 254/342 |
| 42 25 851 A1 | | 4/1993 | (DE) . | |
| 92 04 404 | | 9/1993 | (DE) . | |
| 0 050 073 A1 | | 4/1982 | (EP) . | |
| 1092926 | | 11/1967 | (GB) . | |
| 40465 | * | 3/1979 | (JP) | 54/362 |
| PCT/AU92/ 00527 | | 10/1992 | (WO) . | |
| WO 93/15705 | | 8/1993 | (WO) . | |

* cited by examiner

*Primary Examiner*—Robert P. Olszewski
*Assistant Examiner*—Emmanuel M. Marcelo
(74) *Attorney, Agent, or Firm*—Henry M. Feiereisen

(57) ABSTRACT

A winch including a casing for accommodating an electric motor, a gearbox and a roller for winding and unwinding a traction member. In order to provide a cost-effective flat winch which can be transported by a single person and used universally, in particular for the domestic sector, the casing has a box-like configuration to exhibit a shape and size of a suitcase or attaché case, with the casing having opposite flat outer sides, with one outer side having attached thereon a suspension member, and the other outer side being formed with an opening for passage of the traction member. The electric motor, the gearbox and the roller are arranged in the casing and extend in a common plane, with the casing including a handle to allow transport of the winch by a person. The electric motor may be designed as a universal motor, and connected via a belt drive to the gearbox which is designed as a self-locking worm drive.

18 Claims, 8 Drawing Sheets

PORTABLE WINCH

CROSS-REFERENCES TO RELATED APPLICATIONS

This application claims the priorities of German Patent Application, Serial Nos. 198 51 708.4, filed Oct. 30, 1998 and 199 16 413.4, filed Apr. 1, 1999, the subject matter of which is incorporated herein by reference.

BACKGROUND OF THE INVENTION

The present invention relates, in general, to a winch, and more particularly to a portable winch of a type having a casing for accommodating an electric motor having a motor shaft, a gearbox with a gearbox input shaft in communication with the motor shaft and a gearbox output shaft, and a roller for a traction member connected to a load-bearing member, with the roller mounted in fixed rotative engagement on the gearbox output shaft for winding and unwinding the traction member.

It is generally known to provide winches with a casing. For example, WO 93/15705 describes a ceiling-mounted lifter in which a harness for a patient is attached to a central hook on the underside of the lifter. Provided on the top of the lifter is an opening for guiding a traction member which is connectable to a carriage travelling along a ceiling-mounted track. Accommodated in the lifter casing are an electric motor and its energy supply, together with a gearbox, with the motor shaft being fixedly connected to the gearbox input shaft. A roller for winding and unwinding the traction member is mounted on the gearbox output shaft. At operation, the lifter pulls itself upward, and hence also pulls the person to be transported upward.

A drawback of this conventional lifter is its availability for only a particular use so that this lifter is not universally useable. In addition, this lifter cannot readily be transported by a single person over a relatively great distance without further aids, and the weight and the shape of the lifter permit a person to carry the lifter only around its shoulder.

U.S. Pat. No. 4,434,973 describes a portable hoist which uses a high gear ratio in order to hold the load safely, even without a brake, when the motor is at a standstill. This hoist suffers the drawback that it cannot be used universally and cannot be transported with ease, i.a. because it does not have a balanced center of gravity. Furthermore, the hoist is not completely protected by the casing against outside forces, and has a complicated structure and thus is expensive. Therefore, this hoist is not suitable for domestic use.

SUMMARY OF THE INVENTION

It is thus an object of the present invention to provide an improved winch, obviating the afore-stated drawbacks.

In particular, it is an object of the present invention to provide an improved winch which is cost-effective and universally usable, especially for domestic use, and is transportable with ease by a single person without further aids.

These objects, and others which will become apparent hereinafter, are attained in accordance with the present invention by providing a casing having a box-like configuration to exhibit a shape and size of a suitcase or attaché case, with the casing having opposite flat outer sides, with one outer side having attached thereon a suspension member, and the other outer side being formed with an opening, an electric motor having a motor shaft, a gearbox having an input shaft connected to the motor shaft, and a roller, mounted in fixed rotative engagement on the output shaft of the gearbox, for winding and unwinding a traction member for lifting and lowering a load, with the traction member being guided through the opening in the other outer side of the casing, wherein the electric motor, the gearbox and the roller are arranged in the casing and extend in a common plane, with the casing including a handle for transport of the winch by a single person.

According to another feature of the present invention, the electric motor, the gearbox and the roller for the traction member extend in a common plane, preferably a horizontal plane.

Suitably, the suspension member and the opening extend along a straight line oriented through the center of mass to realize a low wear of the traction member. The use of the winch can be further improved by arranging the suspension member of the flat casing centrally on the one flat outer side, and by arranging the opening at a central location of the opposite flat outer side.

According to another feature of the present invention, the casing may be made from two casing halves which are detachably connected to each other.

Suitably, the handle is placed on a longitudinal side of the casing, thereby further facilitating a transport of the portable winch by a single person.

According to another feature of the present invention, the casing may accommodate a control unit for controlling winding and unwinding of the traction member, to thereby widen the field of use of the portable winch. In order to simplify the operation, the control unit may be configured for remote-control capabilities via a receiver unit arranged in the casing.

Suitably, the winch according to the invention includes for energy supply at least one storage battery which is accommodated in the casing so as to render the operation of the winch independently from the main power supply network. Many applications of the winch can be covered by connecting a power cable for the energy supply to the casing. Suitably, the storage battery can be charged via the power cable. In order to accommodate the power cable, the latter, when not in use, can be wound up manually on at least one winding element arranged on the casing. Winding up the power cable can be further simplified by providing several winding elements for the power cable on a same transverse side of the casing.

According to another feature of the present invention, a box-like, i.e. flat, winch can be realized in a cost-efficient and simple manner, by configuring the electric motor as a universal motor and by configuring the gearbox as a self-locking worm drive, with the universal motor connected to the worm drive via a belt drive. The belt drive, involved here, together with the worm drive is suitable to realize a flat construction. Although a belt drive would normally not be used in hoists for safety reasons because a tearing of the belt could result in hazards for the operator, a proper and safe operation of the universal winch according to the invention is still ensured as a consequence of the combination of the belt drive with a universal motor and a self-locking worm drive.

BRIEF DESCRIPTION OF THE DRAWING

The above and other objects, features and advantages of the present invention will now be described in more detail with reference to the accompanying drawing, in which.

DETAILED DESCRIPTION OF PREFERRED EMBODIMENTS

Figure 1:
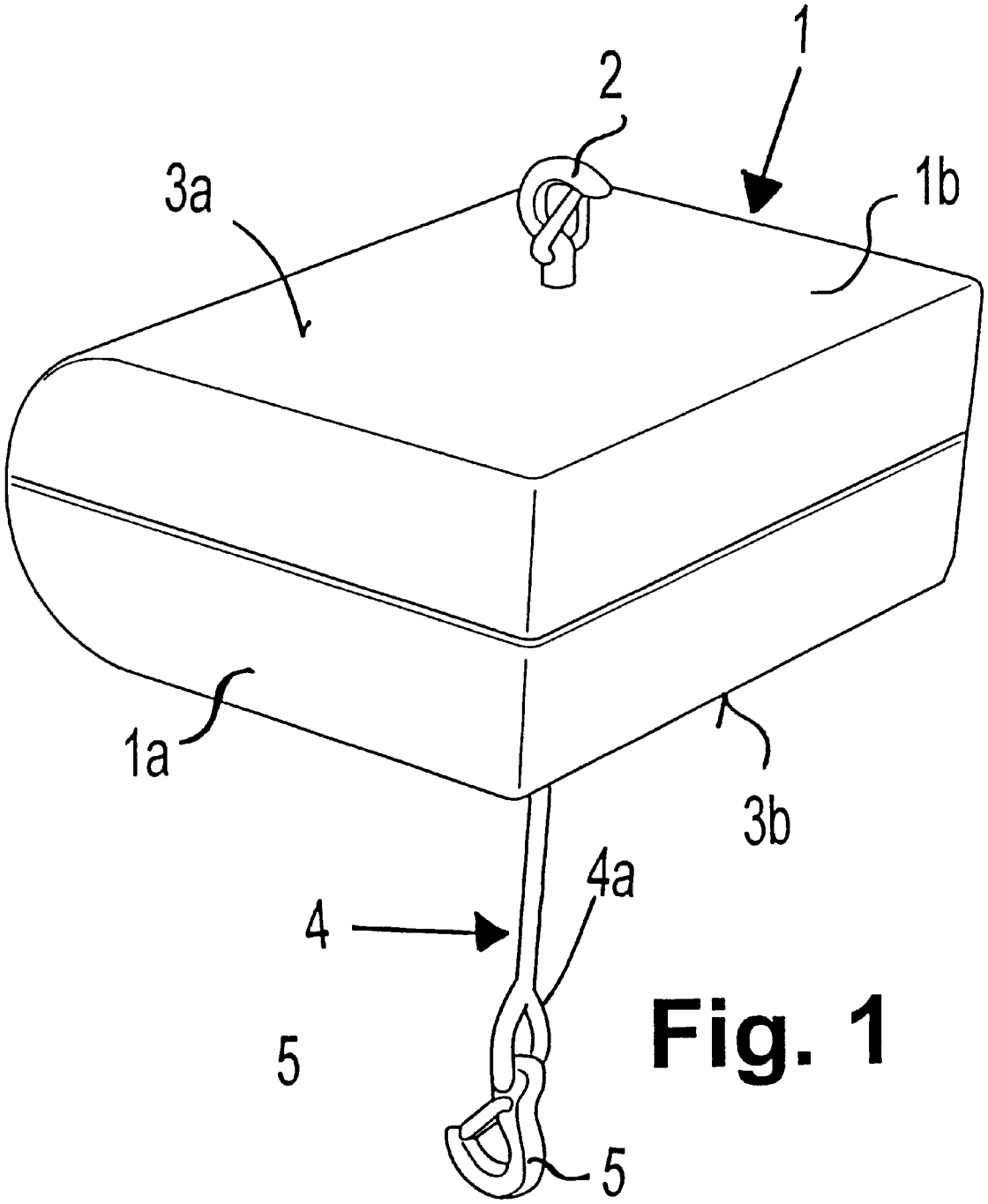
FIG. 1 is a schematic perspective illustration of a winch according to the present invention.

Throughout all the Figures, same or corresponding elements are generally indicated by same reference numerals.

Turning now to the drawing, and in particular to FIG. 1, there is shown a schematic perspective illustration of a winch having a casing, generally designated by reference numeral 1 and made of two casing halves 1*a*, 1*b* which are detachably connected to one another via suitable hinges (not shown). At operation, the two casing halves 1*a*, 1*b* are fixedly secured to one another by a suitable lock mechanism (not shown). The box-like, flat casing 1 resembles a suitcase or attaché case in size and shape, and has opposite flat outer sides 3*a*, 3*b*. Mounted to the outer side 3*a* (in FIG. 1, the top side) is a suspension member 2 in the form of a fastening hook which can be tilted outwards. Formed in the opposite lower flat side 3*b* is an opening 3*c* (cf. FIG. 5) for passage of a traction member 4 such as a rope or cable or chain. The traction member 4 has one end formed as an eyelet 4*a* for attachment of a load-bearing member in the form of a load hook 5.

Figure 2:
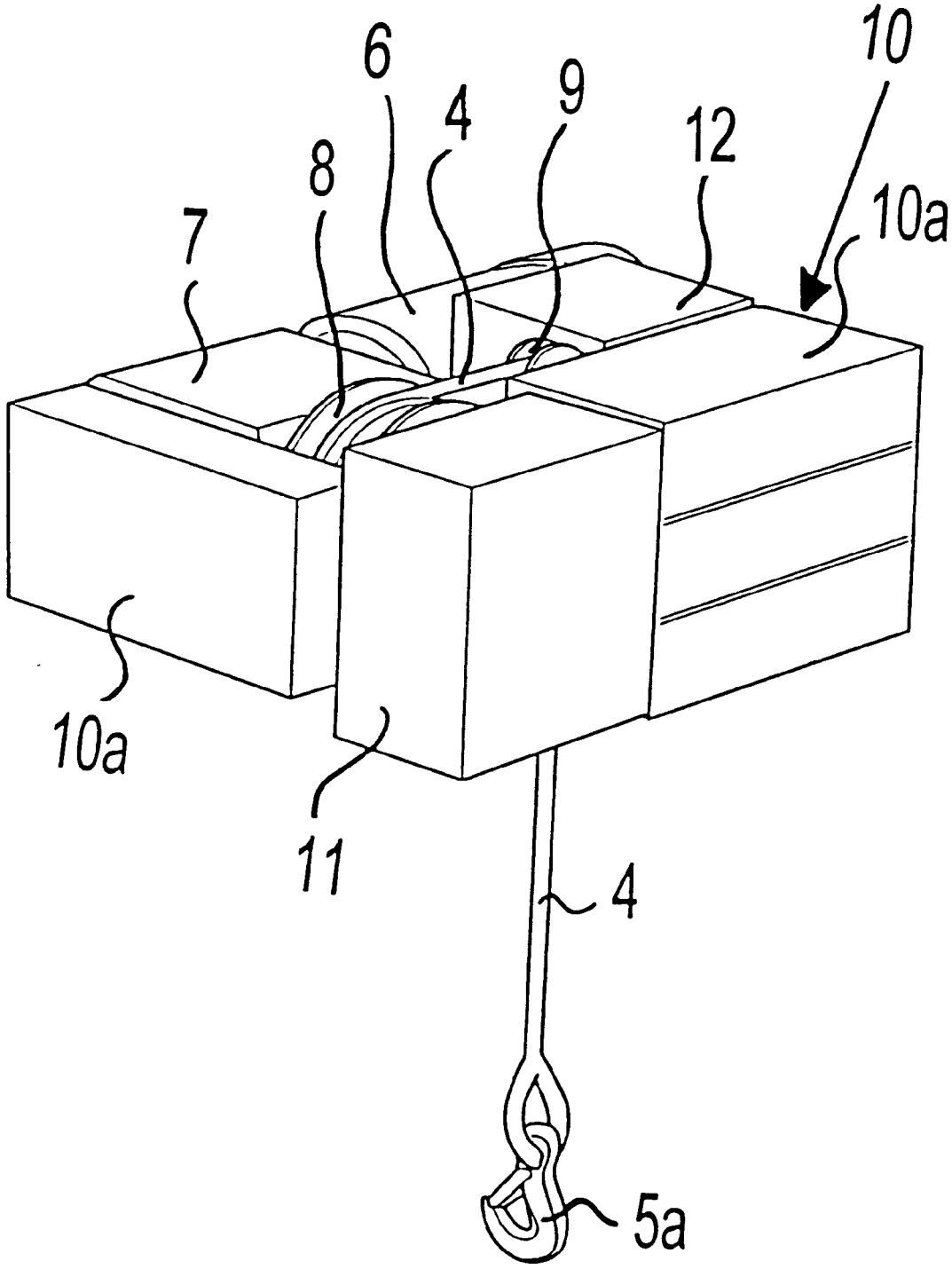
FIG. 2 is a schematic perspective illustration of the winch of FIG. 1, without illustration of the casing.

FIG. 2 shows a perspective view of the winch of FIG. 1, with the casing 1 being removed to illustrate the internal components of the winch. As shown in FIG. 2, the winch includes an electric motor 6, which can be operated with DC and/or AC, a gearbox 7, and a roller 8 for winding and unwinding the traction member 4. It will be appreciated by persons skilled in the art that the configuration of the roller 8 depends on the type of traction member 4 being employed, i.e. when using a rope or cable a typical drum is provided, whereas upon use of a chain, the roller is formed by a sprocket. Thus, it is to be understood that the principles described in the following description with respect to a roller are generally applicable to a sprocket as well.

Figure 3:
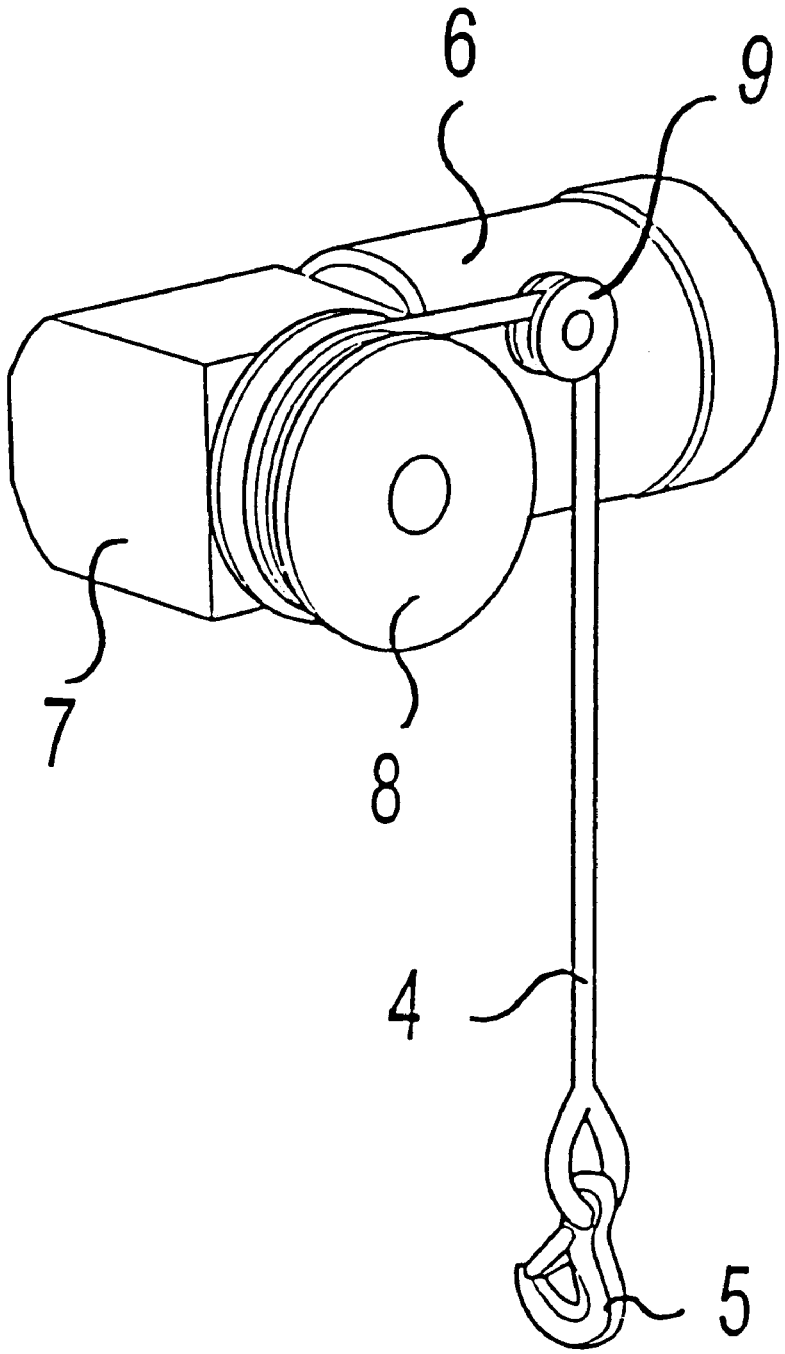
FIG. 3 is a schematic perspective illustration of the winch of FIG. 2, without illustration of the control unit and energy supply.

The gearbox 7 has an input shaft, which is connected in fixed rotative engagement with the motor shaft of the electric motor 6 for conjoint rotation of the input shaft of the gearbox 7 and the motor shaft of the electric motor 6, and an output shaft for support of the roller 8. The traction member 4 is deflected downwards by a further roller 9, as best seen in FIG. 3. FIG. 2 further shows an energy supply, generally designated by reference numeral 10 and arranged in the casing 1. In the non-limiting example of FIG. 2, the energy supply 10 includes storage batteries 10*a*. It will be appreciated by persons skilled in the art that the term "energy supply" includes also a connection to a power supply (main power supply network).

In the exemplified embodiment of the winch, involved here, the casing 1 further accommodates a charger 11 for the storage battery 10*a*, and a control unit 12 which includes an infrared receiver unit 13 (cf. FIG. 7) to thereby permit a remote-controlled operation of the winch, with the input of the receiver unit 13 being accessible from outside. The control unit 12 is used to control the movement of the electric motor 6. Operation and construction of a control unit, involved here, are generally known to a person skilled in the art so that a detailed discussion has been omitted for the sake of simplicity.

Figure 4A:
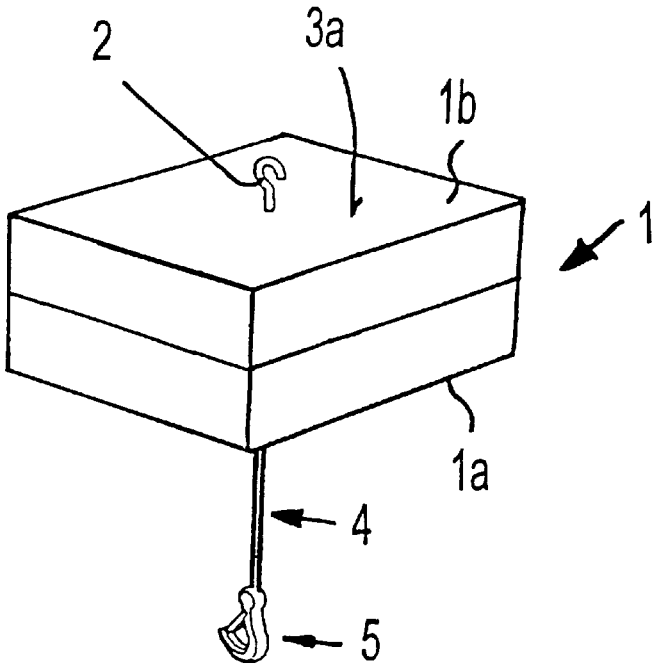
FIG. 4*a* is another schematic illustration of the winch according to FIG. 1.

As shown in FIG. 2, the electric motor 6, the energy supply 10, the gearbox 7 and the roller 8 extend in a common plane. In addition, the suspension member 2 and the opening 3*c* lie on a straight line extending through the center of the mass of the winch, as best seen in FIG. 4*a*. As the suspension member 2 of the flat casing 1 is arranged centrally on the outer side 3*a*, and the opening 3*c* is arranged centrally on the opposite flat outer side 3*b*, the winch, when being suspended, is balanced in operation and occupies essentially a horizontal position.

Figure 4B:
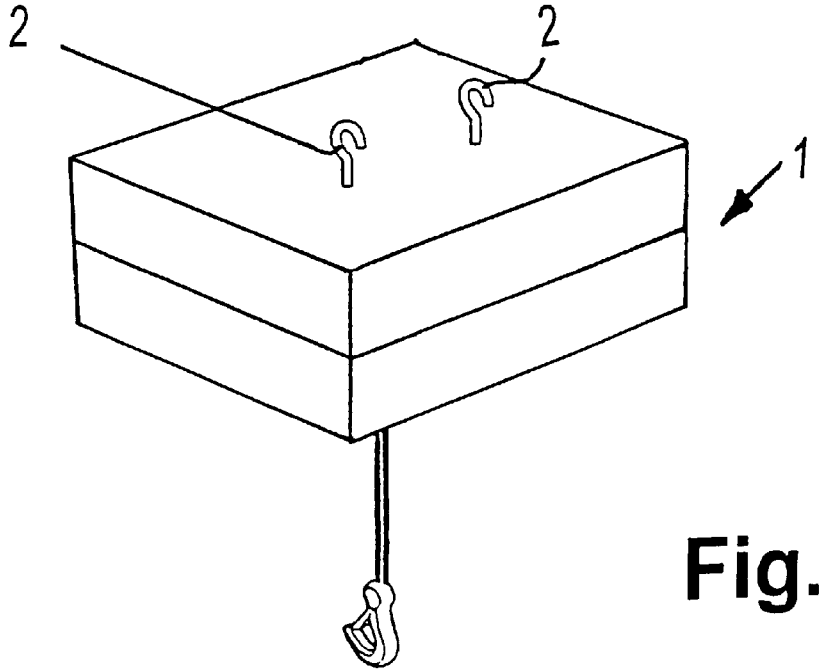
FIG. 4*b* is a schematic illustration of the winch of FIG. 4*a*, with two fastening hooks.

FIG. 4*b* shows a schematic illustration of a modified winch, with the difference with respect to the embodiment of the winch of FIG. 4*a*, residing in the provision of a suspension member 2 in the form of two hooks which are secured in symmetry relative to the center of mass onto the outer side 3*a* of the casing 1, so as to maintain a balanced, horizontal disposition of the suspended winch at operation.

Figure 5:
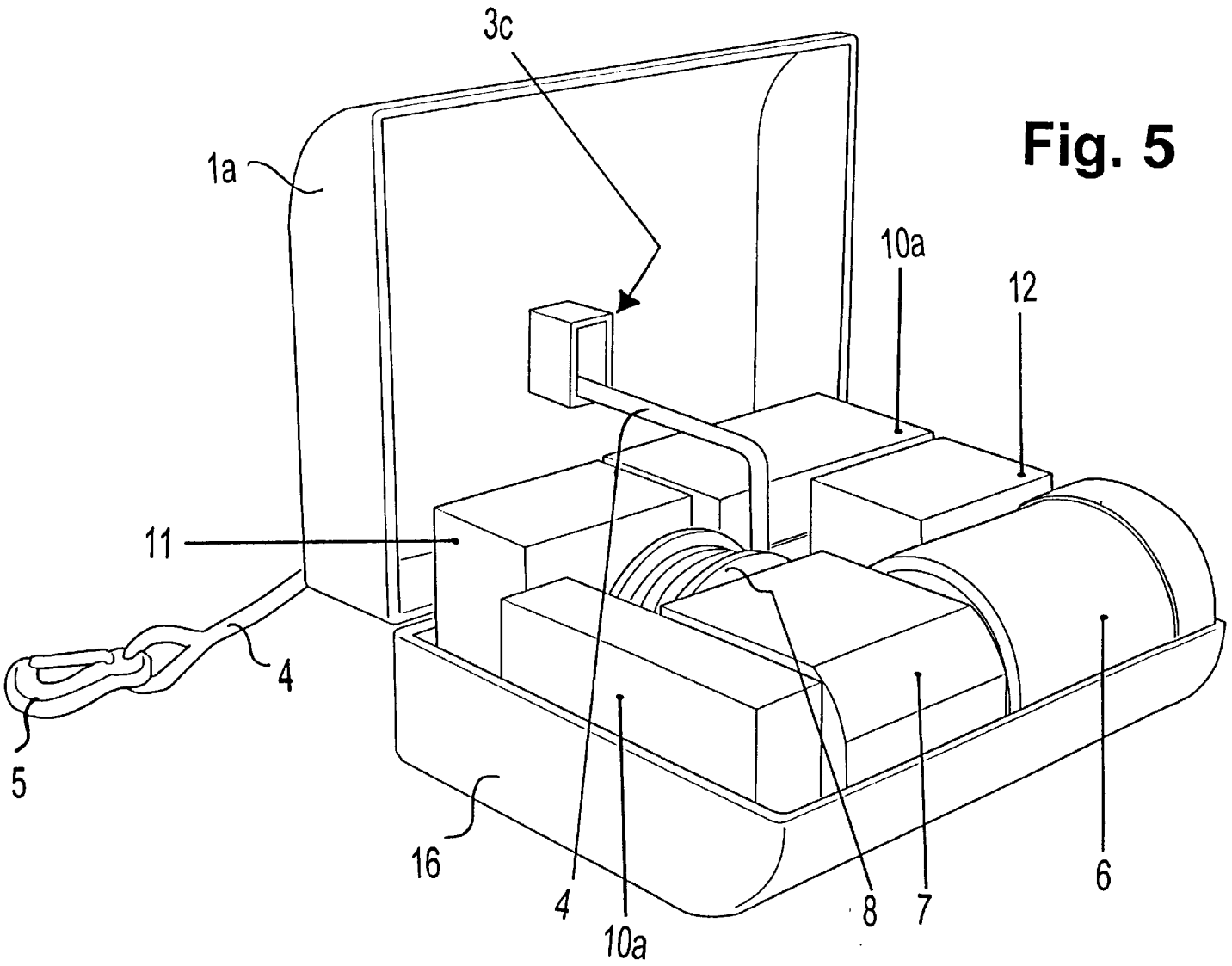
FIG. 5 is a schematic perspective view of the winch of FIG. 1, with the casing being opened.

FIG. 5 is a perspective view of the winch, with the casing 1 being folded open, thereby showing the internal components of the winch, as described in connection with FIG. 2, and positioned in the casing 1.

Figure 6:
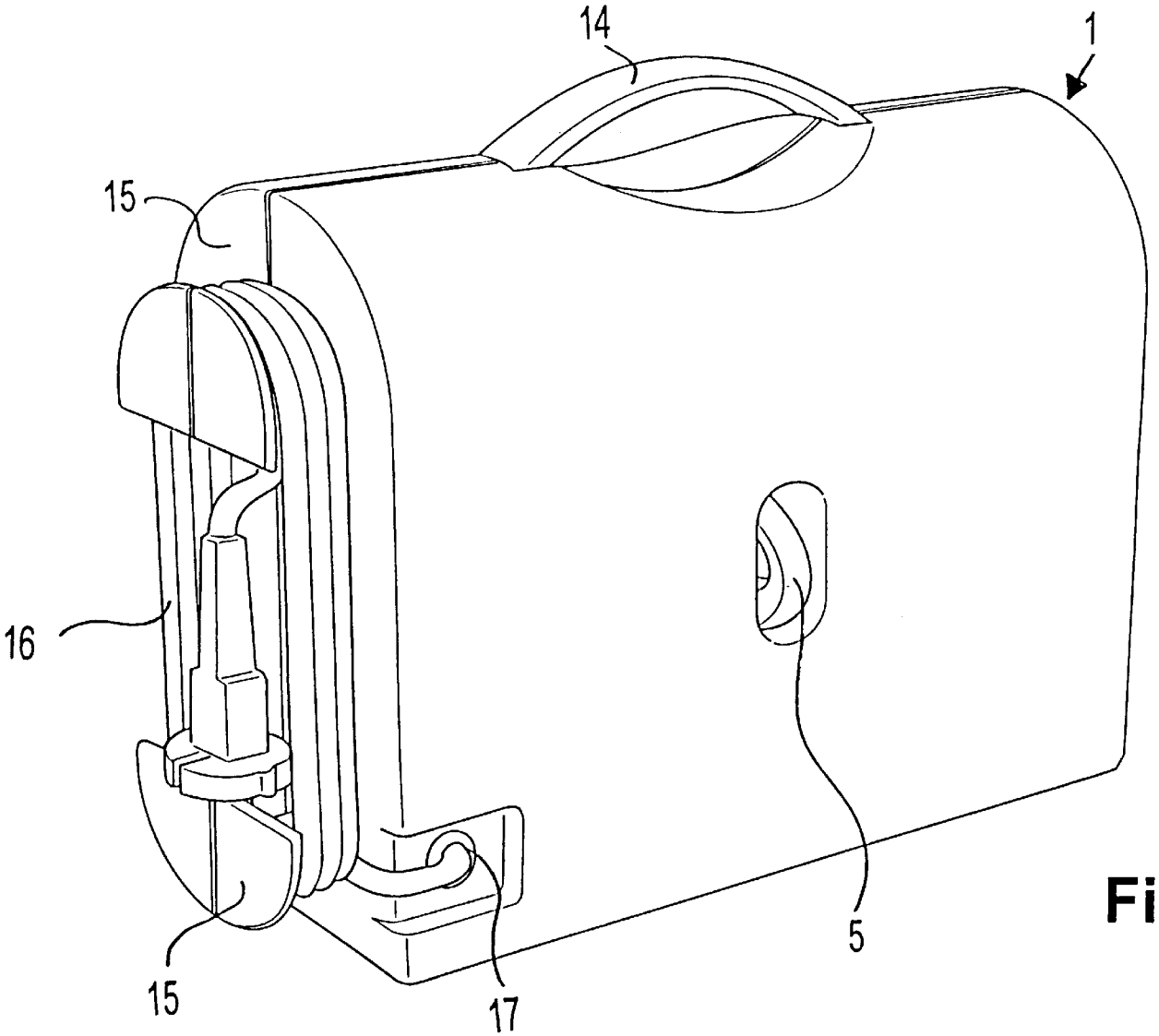
FIG. 6 is a schematic top, rear and left-hand perspective view of the winch of FIG. 1, with illustration of winding elements for winding a power cable.

FIG. 6 shows the winch in the form of a portable "suitcase" or "attaché case". The casing 1 has an upper longitudinal side which is provided with a carrying handle 14. Because of its shape and its weight, the winch can be carried at relative ease by a single person just like any other portable device. Suitably, winding elements 15, onto which a power cable 16 can be wound up, are arranged on the left hand side of the casing 1. The power cable 16 is guided through a casing opening 17 and connected to the control unit 12 and to the charger 11. The winch itself can also be supplied with electrical power via the power cable 16.

Figure 7:
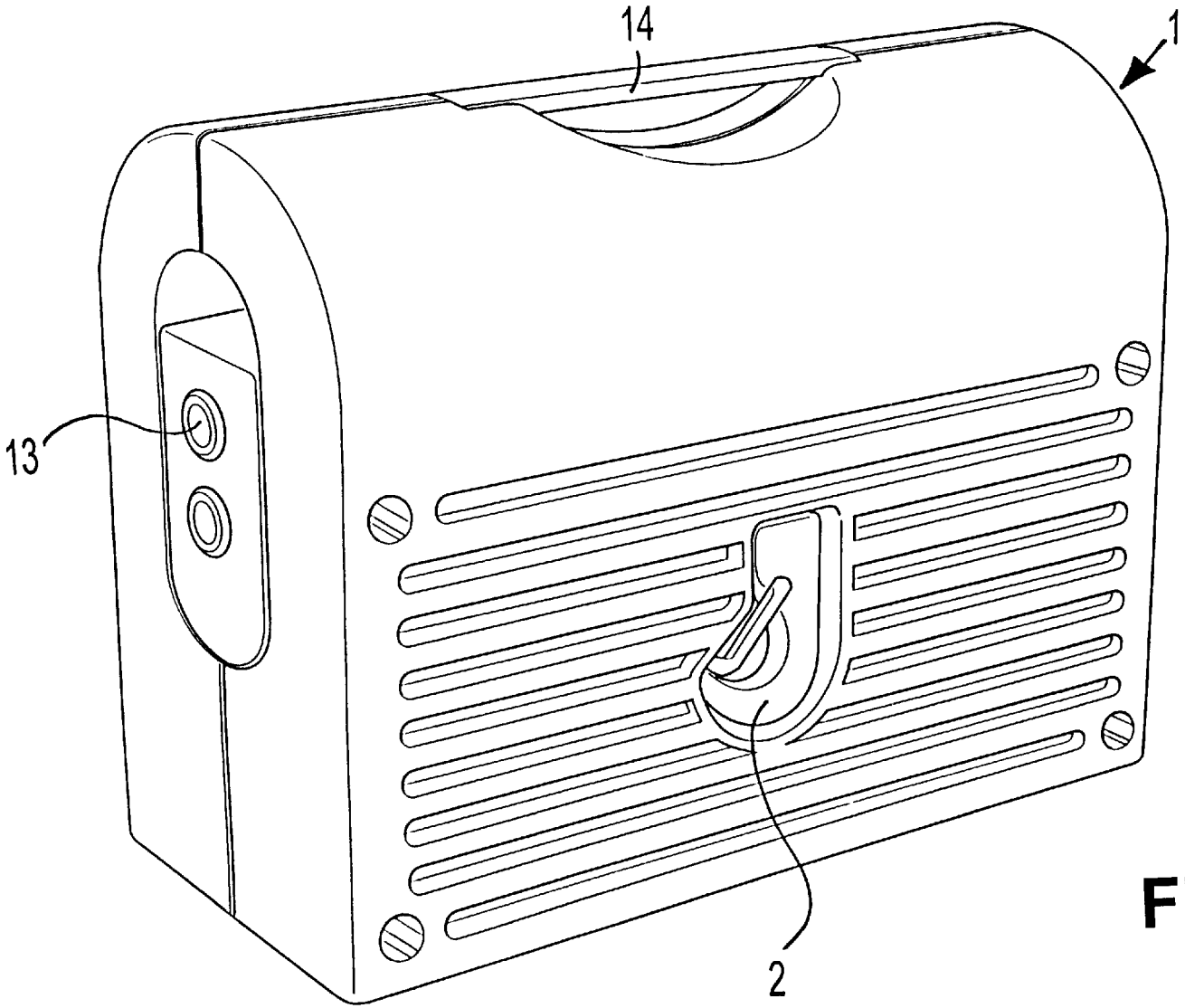
FIG. 7 is a schematic top, front and right-hand perspective view of the winch of FIG. 6.

FIG. 7 shows the casing 1 of the winch according to FIG. 6 viewed from the other side, to thereby illustrate the infrared receiver unit 13. Further provided in the interior of the casing 1 is an accessory compartment (not shown), which is accessible from outside and in which, for example, the hook 2 together with the traction member 4 can be accommodated. The incorporation of the accessory compartment is possible in view of the available free space within the casing 1.

Figure 8:
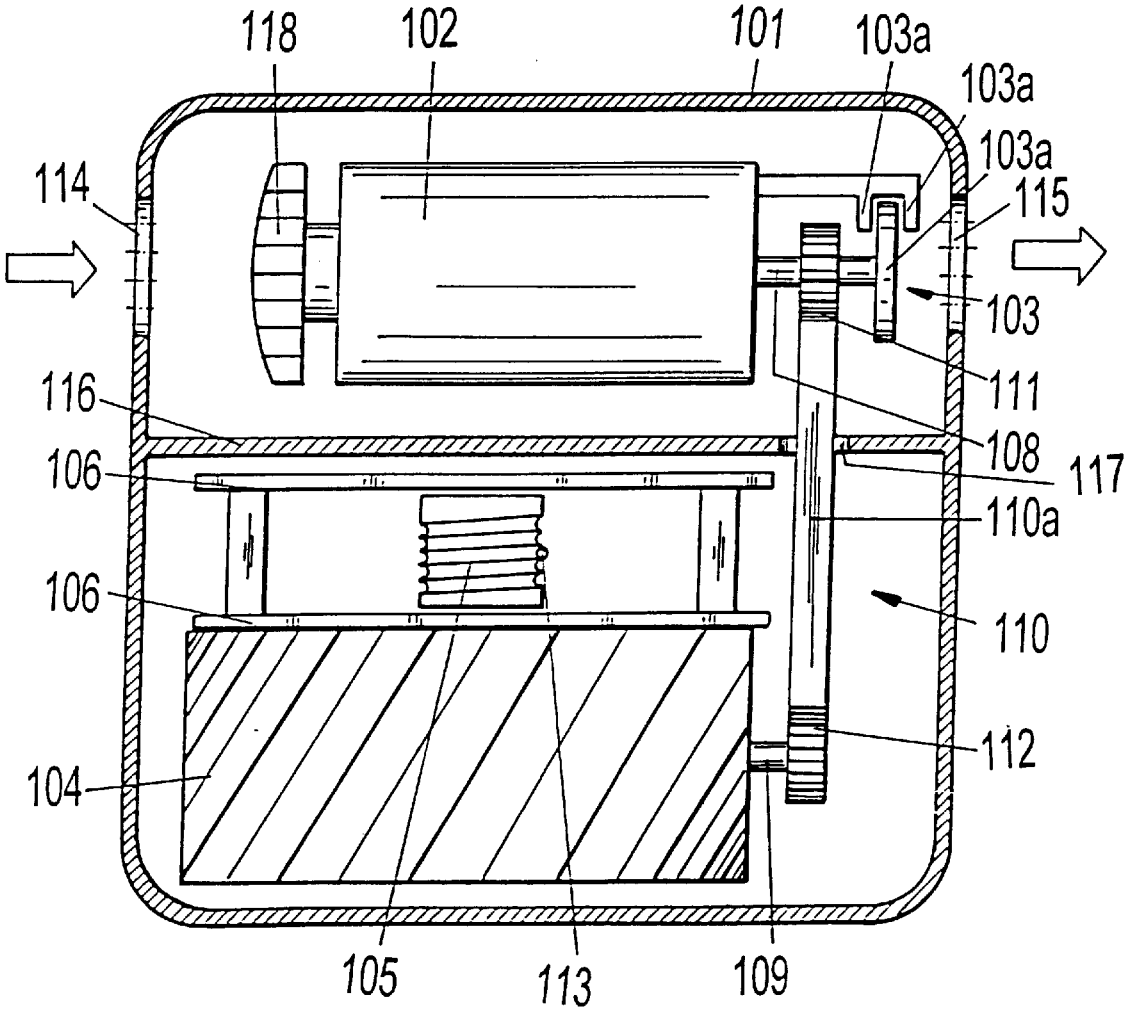
FIG. 8 is a schematic, partially sectional view from above of a winch, embodying the present invention.

Turning now to FIG. 8, there is shown a schematic, partially sectional view from above of a winch, embodying the present invention. The winch has a flat configuration and includes a box-like casing 101, for use in particular as a small hoist. The casing 101 accommodates an electric motor in the form of a universal motor 102 which can be operated with DC and AC, a brake 103 having schematically illustrated brake elements 103a, a gearbox in the form of a worm drive 104, and a traction drive 105 including a roller or drum for a traction member 113, whereby the universal motor 102, the brake 103, the worm drive 104 and the traction drive 105 are arranged in a common plane. Persons skilled in the art will understand that the brake 103 may also be integrated in the electric motor 102, or the electric motor can be so configured as to effect a braking action in a particular mode of operation.

As shown in FIG. 8, the universal motor 102 has a motor shaft 108 which extends parallel to the rotary shaft 109 of the worm drive 104. The motor shaft 108 is connected to the rotary shaft 109 via a belt drive 110 having a belt 110*a* which is trained over a drive wheel 111 in the form of a belt pulley, which is mounted on the output side on the motor shaft 108. A pulley 112, driven by the belt 110*a*, is fastened to the rotary shaft 109 of the worm drive 104. The roller 105 is driven directly by the worm drive 104 and located within a support frame 106 between the universal motor 102 and the worm drive 104. As can be seen from FIG. 8, the roller 105 rotates about a rotation axis which extends at a right angle to the rotary shaft 109 of the worm gear 104. The traction member 113 is guided to the outside via an opening (not shown) in the casing 101.

The casing 101 is further formed with an inlet opening 114 and an outlet opening 115 for circulation of cooling air, as indicated by arrows, by means of a fan 118 mounted on the output-distal end of the motor shaft 108. A partition wall 116 subdivides the interior of the casing 101 into a compartment that includes the electric motor 102 and is cooled by the circulating air, and an adjacent compartment in which the worm drive 104 and the roller 105 are located. Only a small opening for the passage of the belt 110*a* is provided in the partition wall 116. The fan 118 draws cooling air through the inlet opening 114 and forces air through the casing compartment being cooled in a direction longitudinally of the motor shaft 108. Thus, cooling air cools the universal motor 102 and the brake 103 during operation of the motor.

The universal motor 102 includes a plurality of motor windings connected in series, and is therefore also designated a series-wound commutator motor. It can be operated only as a motor (so-called 2-quadrant operation), and thus does not produce a generator torque, and can therefore not be braked by the generator torque. Both motor windings of the universal motor 102 include a rotor winding and one or more stator windings. For example, two stator windings arranged parallel to each other may be provided on either side of the rotor winding. During motor operation, all three motor windings are connected in series.

The worm drive 104 has a self-locking action which is so adjusted that the worm drive 104 is capable to hold even a greatest load when the universal motor 102 is at a standstill. When the worm is at a standstill, the self-locking action is at a maximum; it decreases with increasing rotational speed of the worm, i.e. the universal motor 102 is acted upon by a speed-dependent load torque. Consequently, the self-locking worm drive 104 acts as a continuously effective brake during lifting and lowering of a load.

While the invention has been illustrated and described as embodied in a portable winch, it is not intended to be limited to the details shown since various modifications and structural changes may be made without departing in any way from the spirit of the present invention.

What is claimed as new and desired to be protected by Letters Patent is set forth in the appended claims:

1. A winch, comprising:

a casing having a box-like configuration having opposite flat outer sides, with one of the outer sides having attached thereon a suspension member, and the other one of the outer sides formed with an opening;

an electric motor having a motor shaft;

a gearbox having an input shaft connected to the motor shaft; and a traction means, mounted in fixed rotative engagement on the output shaft of the gearbox, for winding and unwinding a traction member for lifting and lowering a load, with the traction member being guided through the opening in the other outer side of the casing, wherein the electric motor, the gearbox and the traction means are arranged in the casing and extend in a common plane, with the casing including a handle to allow transport of the winch by a person.

2. The winch of in claim 1, wherein the suspension member and the opening lie on a straight line extending through the center of mass of the winch.

3. The winch of claim 1, wherein the suspension member is arranged centrally on the one outer side, and the opening is arranged centrally on the opposite other outer side.

4. The winch of claim 1, wherein the casing is made of two casing halves detachably connected to each other.

5. The winch of claim 1, wherein the handle is arranged on a longitudinal side of the casing.

6. The winch of claim 1, and further comprising a control unit accommodated in the casing for controlling the electric motor.

7. The winch of claim 6, wherein the control unit includes a receiver unit accommodated in the casing for remote-controlled operation of the control unit.

8. The winch of claim 1, and further comprising an energy supply arranged in the casing and including at least one storage battery.

9. The winch of claim 8, and further comprising a power cable attachable to the casing for connection to the energy supply.

10. The winch of claim 9, wherein the storage battery is chargeable via the power cable.

11. The winch of claim 9, wherein the casing includes at least one winding element for winding up by hand the power cable, when not in use.

12. The winch of claim 1, wherein the casing has a transverse side which is formed with a plurality of winding elements for winding up by hand the power cable.

13. The winch of claim 1, wherein the electric motor is a universal motor, and the gearbox is a self-locking worm drive, with the self-locking action acting as a brake.

14. The winch of in claim 13, wherein the universal motor is connected to the worm drive via a belt drive.

15. The winch of in claim 1, wherein the traction means includes one of a roller and a drum.

16. A winch, comprising:

a casing;

an electric motor having a motor shaft and designed as a universal motor;

a gearbox having an input shaft connected to the motor shaft, said gearbox being designed as a self-locking worm drive, with the self-locking action acting as a brake;

a belt drive for connecting the universal motor to the worm drive; and a traction means, mounted in fixed rotative engagement on the output shaft of the gearbox, for winding and unwinding a traction member for lifting and lowering a load;

wherein the electric motor, the gearbox and the traction means are arranged in the casing.

17. The winch of claim 16, wherein the casing has a box-like configuration having opposite flat outer sides, with one of the outer sides having attached thereon a suspension member, and the other one of the outer sides formed with an opening for passage of the traction member, said casing including a handle to allow transport of the winch by a person.

18. The winch of claim 16, wherein the electric motor, the gearbox and the traction means extend in a common plane.

* * * * *